US007661713B2

(12) United States Patent
Panizza

(10) Patent No.: US 7,661,713 B2
(45) Date of Patent: Feb. 16, 2010

(54) UNIT FOR COUPLING AND RELEASING THE WRIST STRAP TO/FROM THE HANDGRIP OF A POLE FOR SPORTING ACTIVITIES LIKE SKIING, TREKKING AND THE LIKE

(75) Inventor: Paolo Panizza, Bassano Del Grappa (IT)

(73) Assignee: Gabel S.r.l., Rosa' (VI) (IT)

( * ) Notice: Subject to any disclaimer, the term of this patent is extended or adjusted under 35 U.S.C. 154(b) by 496 days.

(21) Appl. No.: 11/605,651

(22) Filed: Nov. 29, 2006

(65) Prior Publication Data

US 2007/0120353 A1 May 31, 2007

(30) Foreign Application Priority Data

Nov. 30, 2005 (IT) ..... VI2005A0317

(51) Int. Cl.
*A63C 11/00* (2006.01)

(52) U.S. Cl. ..... 280/821; 280/822

(58) Field of Classification Search ..... None
See application file for complete search history.

(56) References Cited

U.S. PATENT DOCUMENTS

| | | | | | |
|---|---|---|---|---|---|
| 3,297,333 | A * | 1/1967 | Schwedt et al. | ..... | 280/820 |
| 3,560,014 | A * | 2/1971 | Bruckl et al. | ..... | 280/821 |
| 3,982,747 | A * | 9/1976 | Schweinsberg | ..... | 280/822 |
| 4,288,100 | A * | 9/1981 | Aho | ..... | 280/821 |
| 4,288,101 | A * | 9/1981 | Aho | ..... | 280/821 |
| 4,416,036 | A * | 11/1983 | Aho | ..... | 24/136 R |
| 5,110,154 | A * | 5/1992 | Street | ..... | 280/822 |
| 5,123,674 | A * | 6/1992 | Bagneres et al. | ..... | 280/821 |
| 5,123,686 | A * | 6/1992 | Wenk | ..... | 292/321 |
| 5,306,885 | A * | 4/1994 | Utke | ..... | 200/338 |
| 5,443,287 | A * | 8/1995 | Wells | ..... | 280/822 |
| 6,101,684 | A * | 8/2000 | Ginocchio | ..... | 24/16 R |
| 6,264,242 | B1 * | 7/2001 | Lenhart | ..... | 280/822 |
| 6,325,418 | B1 * | 12/2001 | Lenhart | ..... | 280/821 |
| 6,637,773 | B1 * | 10/2003 | Trinen et al. | ..... | 280/821 |
| 7,226,084 | B2 * | 6/2007 | Lenhart | ..... | 280/822 |
| 2008/0005826 | A1 * | 1/2008 | Lenhart | ..... | 2/160 |
| 2008/0012286 | A1 * | 1/2008 | Lenhart | ..... | 280/821 |

FOREIGN PATENT DOCUMENTS

| | | | |
|---|---|---|---|
| DE | 4103235 | A1 | 8/1992 |
| DE | 202006011105 | U1 | 10/2006 |
| EP | 1491241 | A1 | 12/2004 |
| FR | 2668377 | A1 * | 4/1992 |
| FR | 2668378 | A1 * | 4/1992 |
| WO | WO 8602852 | A1 * | 5/1986 |
| WO | 0234343 | A1 | 5/2002 |

* cited by examiner

*Primary Examiner*—Lesley Morris
*Assistant Examiner*—Chiedu A Chibogu
(74) *Attorney, Agent, or Firm*—IP Strategies

(57) ABSTRACT

The invention is a unit for coupling and releasing the wrist strap to/from the handgrip of a pole for sporting activities, e.g. skiing, trekking and the like, comprising: a buckle with which the wrist strap is associated; a housing obtained in the handgrip housing the buckle; coupling means comprising an elastic tab projecting from the body of the buckle and cooperating with a corresponding support surface obtained in the housing to fix the buckle to the handgrip; releasing means that can be reached by the user and are inserted in the housing, suitable for cooperating with the elastic tab to release the buckle from the handgrip.

8 Claims, 5 Drawing Sheets

UNIT FOR COUPLING AND RELEASING THE WRIST STRAP TO/FROM THE HANDGRIP OF A POLE FOR SPORTING ACTIVITIES LIKE SKIING, TREKKING AND THE LIKE

BACKGROUND OF THE INVENTION

The present invention relates to a unit for coupling and releasing the wrist strap to/from the handgrip of a pole for sporting activities, e.g. skiing, trekking and the like.

It is known that the poles that are used in the sporting activities mentioned above substantially comprise a tubular body that develops mainly in longitudinal direction and is provided at one end with a tip and at the opposite end with a handgrip that is grasped by the user.

The handgrip of the pole is associated with a wrist strap provided with a buckle that is inserted in a housing obtained in the handgrip, where coupling means suited to fix the buckle are present.

The buckle is extracted by the user with the aid of suitable releasing means.

According to the known technique, the coupling means and the releasing means are carried out with different configurations, all aimed to make the operations necessary for coupling and releasing the wrist strap to/from the handgrip quick and easy.

SUMMARY OF THE INVENTION

One of the aims of the present invention is to propose a unit for coupling and releasing the wrist strap to/from the handgrip of a pole for sporting activities that is particularly easy to construct.

Another aim of the present invention is to propose a unit whose operation is reliable.

It is another, yet not the least aim of the invention, to propose a unit that is easy to handle both in the coupling and in the releasing stage.

The aims mentioned above have been achieved through the construction of a unit for coupling and releasing the wrist strap to/from the handgrip of a pole for sporting activities like skiing, trekking and the like that according to the main claim is characterized in that it comprises:

- a buckle with which said wrist strap is associated;
- a housing obtained in said handgrip to house said buckle;
- coupling means comprising at least one elastic tab projecting from the body of said buckle and cooperating with a corresponding support surface obtained in said housing to fix said buckle to said handgrip;
- releasing means easy to reach for the user, inserted in said housing and cooperating with said elastic tab to free said buckle from said handgrip.

According to the preferred embodiment of the invention described here below, the housing consists of a through hole with closed profile in cross section, which passes obliquely through the body of the handgrip, starting from its top and ending in one of its lateral areas.

The buckle is fitted—with a sliding movement—in its housing, where there are the coupling means comprising the elastic tab with which the buckle is provided and the corresponding support surface with which the tab cooperates, said support surface being obtained inside the housing itself.

The releasing means comprise a button that can be pressed by the user, positioned in the above mentioned housing, accessible from the top of the handgrip and associated with a sheet projection that forces against the elastic tab to release it from the support surface and enable separation of the buckle when said button is pressed.

Advantageously, the coupling and releasing unit that is the subject of the invention is easy to carry out and its operation is reliable.

BRIEF DESCRIPTION OF THE DRAWINGS

The aims and advantages described above will be highlighted in greater detail in the description of a preferred embodiment of the invention, with reference to the attached drawings, wherein.

DESCRIPTION OF THE INVENTION

Figure 1:
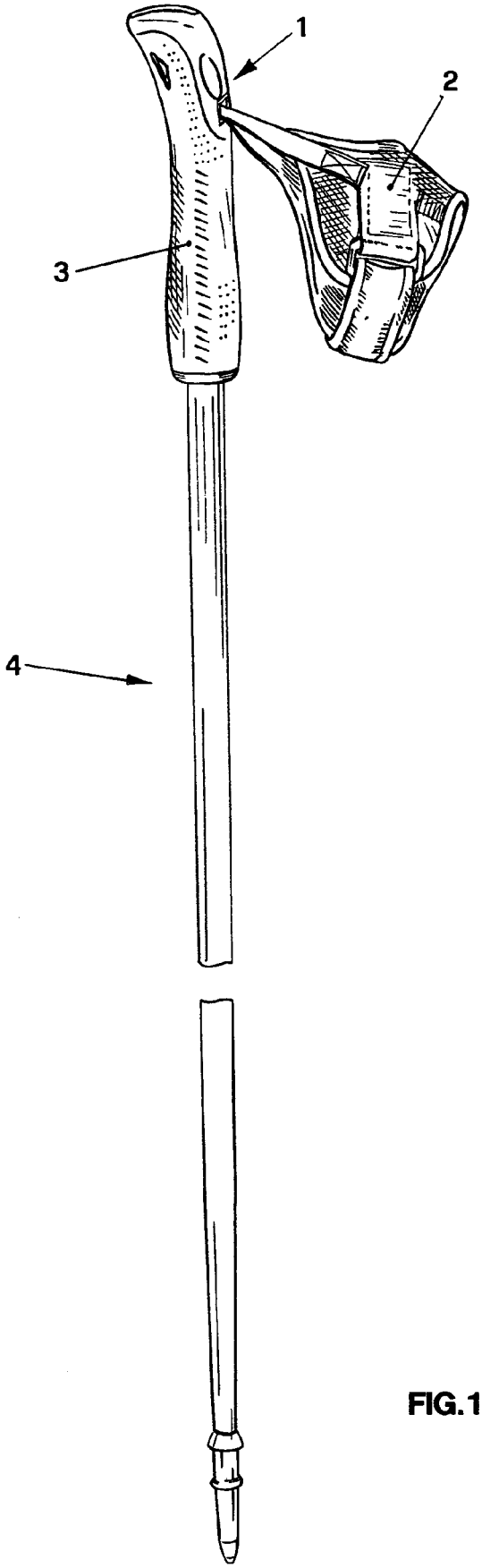
FIG. 1 shows a pole for sporting activities, e.g. skiing, trekking and the like, with a corresponding unit for coupling and releasing the wrist strap to/from the handgrip that is the subject of the invention.
Figure 2:
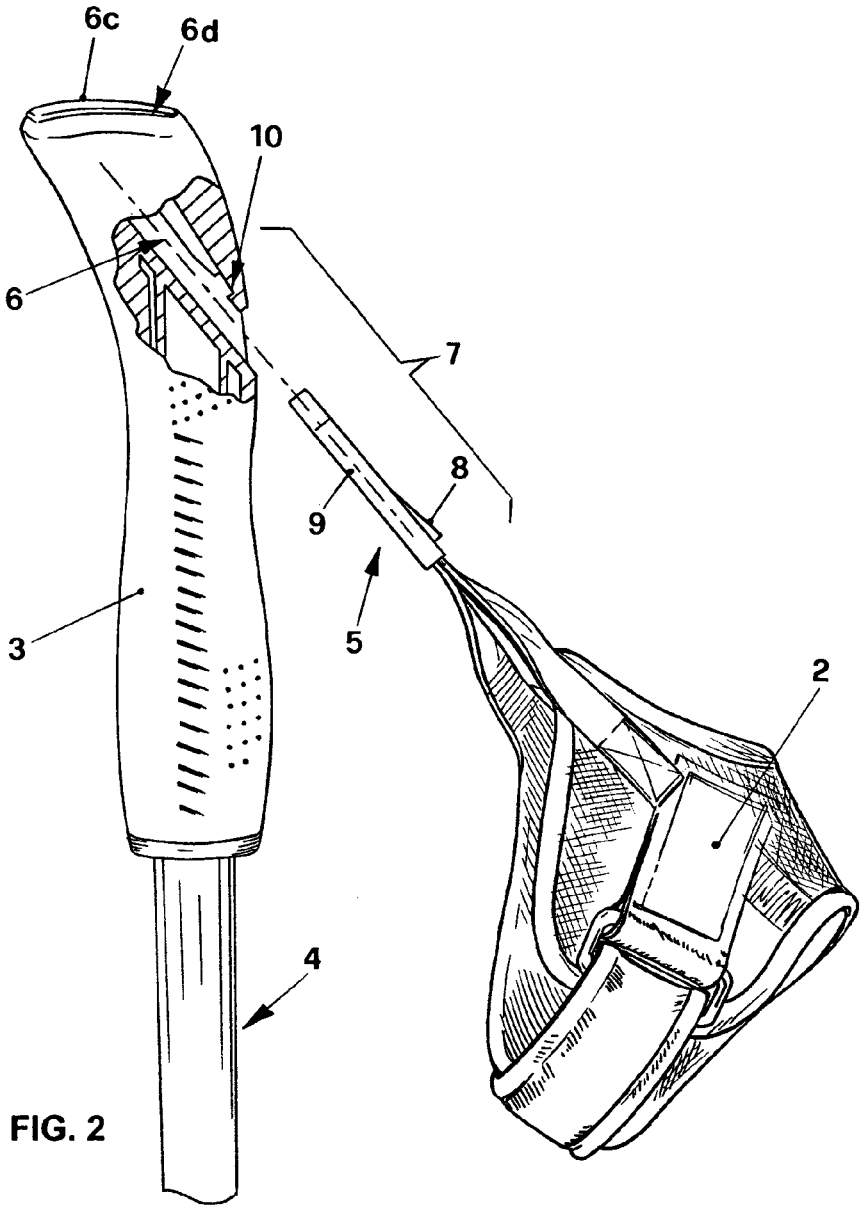
FIG. 2 shows an exploded view, in partial cross section, of a detail of the handgrip and wrist strap with buckle shown in FIG. 1.
Figure 3:
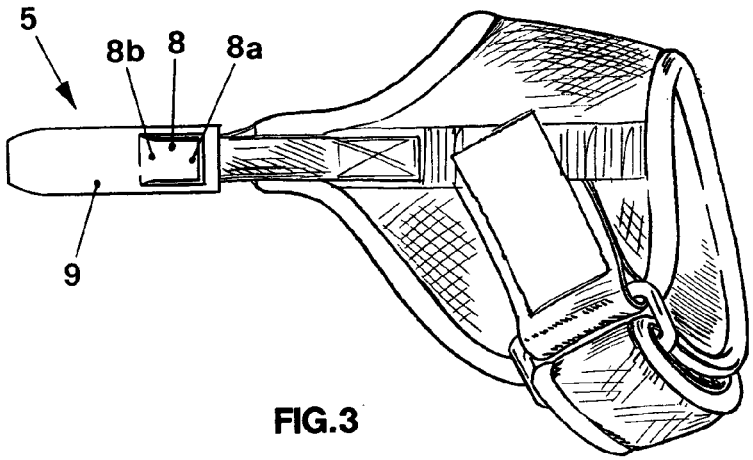
FIG. 3 shows the wrist strap with buckle shown in FIG. 2, with the buckle arranged in a different position.

The coupling and releasing unit that is the subject of the invention is shown in FIG. 1, where it is indicated as a whole by 1 and where it connects the wrist strap 2 to the handgrip 3 of a pole 4 for sporting activities, like for example skiing, trekking and the like.

According to the invention and with reference to FIGS. from 2 to 4, the coupling and releasing unit comprises:

- a buckle 5 with which said wrist strap 2 is associated;
- a housing 6 obtained in said handgrip 3 to house said buckle 5;
- coupling means 7 comprising at least one elastic tab 8 projecting from the body 9 of said buckle 5 and cooperating with a corresponding support surface 10 obtained in said housing 6;
- releasing means 11 that can be reached by the user and are inserted in said housing 6, suitable for cooperating with said elastic tab 8 to release said buckle 5 from said handgrip 3.

It can be observed in particular that the housing 6 is a through hole with closed profile in cross section, arranged obliquely in such a way as to pass through the handgrip 3 starting from its top, where it defines a top hole 3*a*, and ending in a lateral area where it defines a side hole 3*b*.

More particularly, the housing 6 is defined by a first guiding surface 6*a* on which the buckle slidingly rests and by a second guiding surface 6*b*, opposite the first guiding surface 6*a*, on which the releasing means 11 slidingly rest, said surfaces being included between a pair of containing surfaces 6*c*, 6*d* opposite each other.

The guiding surfaces 6*a*, 6*b* are mutually inclined and diverging towards the top hole 3*a* of the handgrip 3, in such a way as to substantially define for the housing 6 the shape of a quadrangular pyramid frustum.

Figures 5, 6:
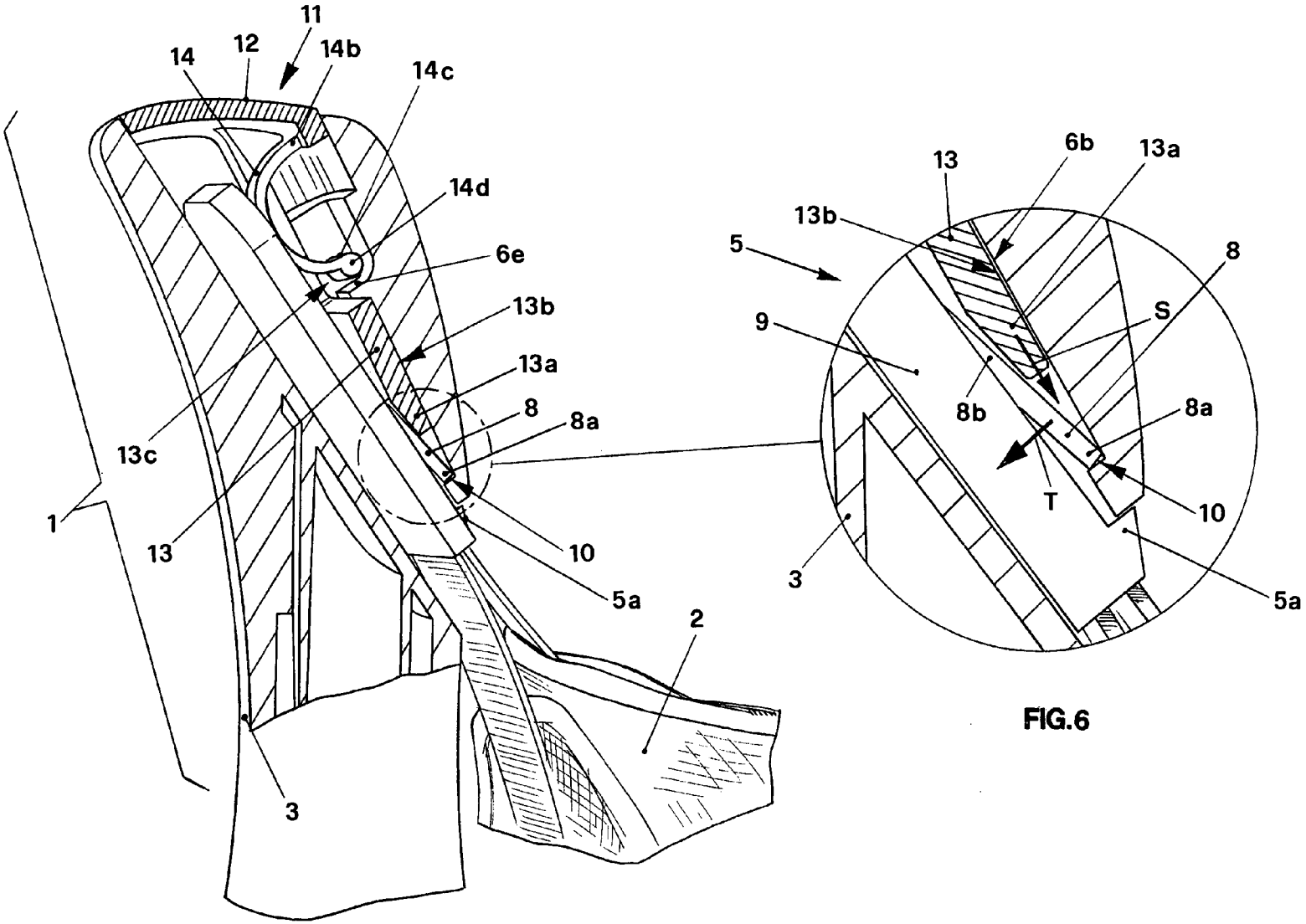
FIG. 5 shows the coupling and releasing unit shown in FIG. 4 once assembled.
FIG. 6 shows a detail of FIG. 5.

In particular, on the second guiding surface 6*b* it is possible to identify the support surface 10 projecting from it, on which the free end 8*a* of the elastic tab 8 rests, as can be seen in the coupling configuration shown in FIGS. 5 and 6.

In particular, the elastic tab 8 is connected to the body 9 of the buckle 5, with which it forms a single body, at the level of the end 8*b*, opposite the free end 8*a*, and it is inclined and diverging towards the end of the buckle 5 with which the wrist strap 2 is associated.

As regards the releasing means 11, it can be observed with particular reference to FIGS. from 4 to 7 that they comprise a button 12 that can be reached by the user and is positioned in the top hole 3*a* of the handgrip 3, which is provided with a sheet projection 13 for releasing the elastic tab 8 from the support surface 10.

The sheet projection 13, in fact, is arranged between the second guiding surface 6*b* and the buckle 5, as shown in FIGS. from 5 to 7, and has its end 13*a* in contact with the projecting elastic tab 8.

In the sheet projection 13 it is also possible to identify a wall 13*b* that rests on the second guiding surface 6*b* and an elastic body 14 facing towards the body 9 of the buckle 5.

In particular, the elastic body 14 has a curved shape, with the convex part 14*a* in contact with the body 9 of the buckle 5 and is housed in a through opening 13*c* made in the sheet projection 13 itself.

Furthermore, the elastic body 14 has one end 14*b* fixed to the button 12 of which it forms an integral part, while the opposite end 14*c* is free and provided with projecting shaped parts 14*d*. These, in particular, cooperate with recesses 6*e* present in the housing 6.

In this way, when the button 12 is pressed, the end 13*a* of the sheet projection 13 counteracts the action of the elastic tab 8 to release its free end 8*a* from the support surface 10 and at the same time the projecting shaped parts 14*d* rest against the recesses 6*e* and elastically load the elastic body 14.

When pressure on the button 12 ceases and after the release of the buckle 5, the elastic recovery of the elastic body 14 allows the button 12 to return to the rest position, as will be described below.

Figure 4:
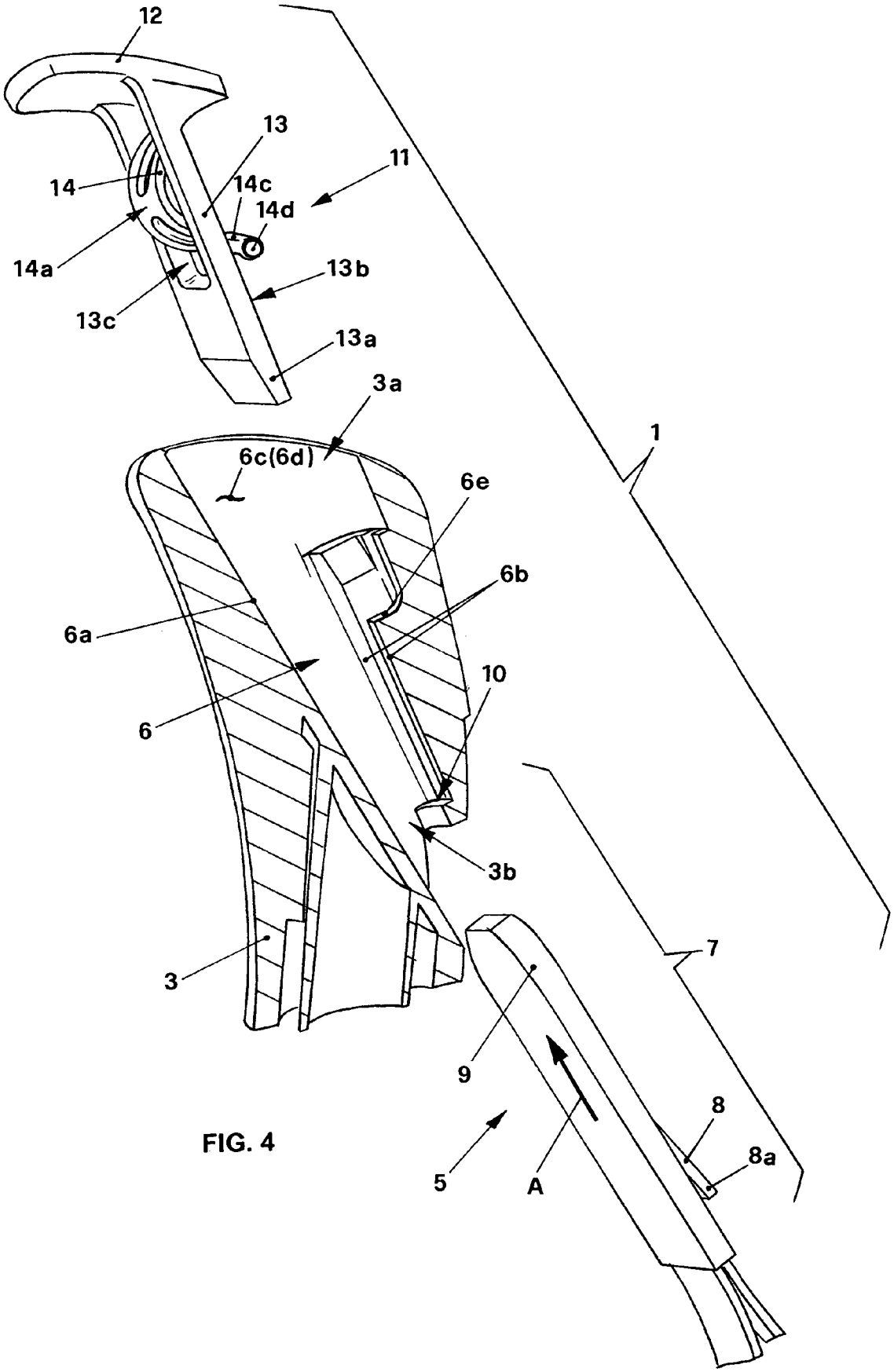
FIG. 4 is an exploded view in cross section of the coupling and releasing unit carried out according to the invention.

In practice, to connect the wrist strap 2 to the handgrip 3 of the pole 4, the buckle 5 is inserted in the side hole 3*b* and pushed inside the housing 6 in the direction indicated by the arrow A as shown in FIG. 4.

Acting against the side hole 3*b*, the elastic tab 8 compresses to allow the passage of the buckle 5.

When the free end 8*a* of the projecting elastic tab 8 is beyond the side hole 3*b*, it expands, due to spontaneous elastic recovery, returns to the rest position and rests against the support surface 10 as can be seen in FIGS. 5 and 6.

In this position it prevents the buckle 5 and therefore the wrist strap 2 from coming off the handgrip 3.

A stop tooth 5*a* belonging to the buckle 5 limits its stroke during introduction in the housing 6.

Figure 7:
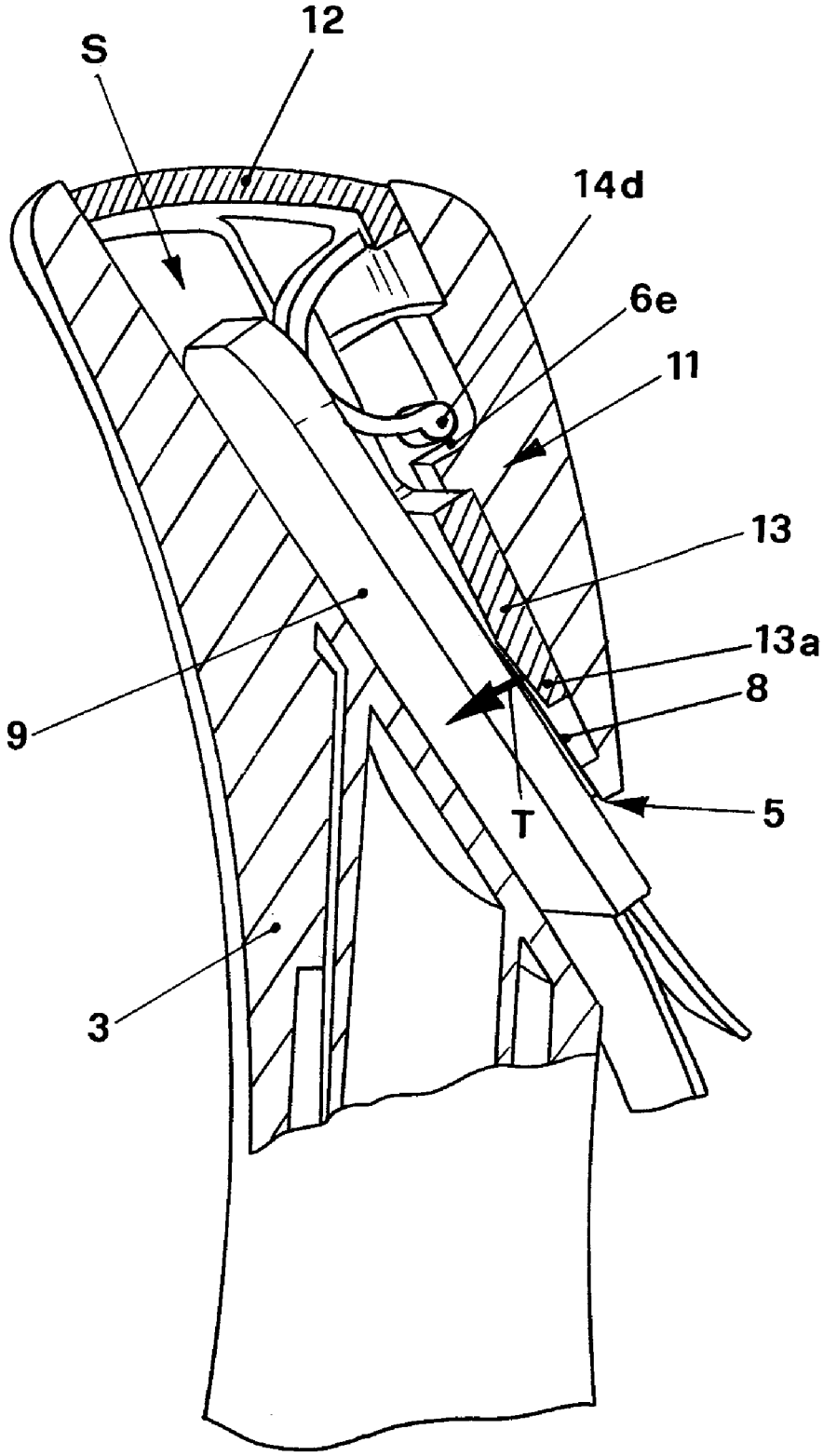
FIG. 7 shows the unit shown in FIG. 4 during the releasing stage.

To release the buckle 5 from the handgrip 3, the user presses the button 12 in the direction and sense indicated by the arrow S as shown in FIG. 7, so that the end 13*a* of the sheet projection 13 forces against the elastic tab 8 and bends it towards the body 9 of the buckle 5, as indicated by the arrow T shown in FIGS. 6 and 7, until releasing its end 8*a* from contact with the support surface 10.

Once the releasing operation has been completed, it is possible to separate the buckle 5 from the handgrip 3 by applying a traction force to the wrist strap 2 in the direction indicated by the arrow S of FIG. 7.

After extraction, the release of the button 12 causes the elastic recovery of the elastic body 14 that during the releasing operation has been elastically loaded due to the opposing action of the projecting shaped parts 14*d* against the recesses 6*e*, and brings the button 12 back to the rest position that can be observed in FIG. 5.

It is therefore clear, according to the above description, that the coupling and releasing unit carried out according to the invention achieves all the aims set.

In particular, the invention achieves the aim to carry out a coupling and releasing unit that is particularly simple to construct and whose operation is reliable.

It can be observed, in fact, that all the parts that make it up are easy to construct and their operating principle is based on mutual elasticity.

In the construction stage the parts that make up the coupling and releasing unit may be modified.

If said construction variants entail embodiments that are included in the scope of the claims expressed below, they must all be considered protected by the present patent.

The invention claimed is:

1. Unit for coupling and releasing the wrist strap to/from the handgrip of a pole for sporting activities, e.g. skiing, trekking and the like, wherein the unit comprises:

a buckle with which said wrist strap is associated;

a housing obtained in said handgrip to house said buckle;

coupling means comprising at least one elastic tab projecting from the body of said buckle and cooperating with a corresponding support surface obtained in said housing to fix said buckle to said handgrip; and releasing means that can be reached by the user when inserted in said housing, suitable for cooperating with said elastic tab to release said buckle from said handgrip;

wherein said housing is defined by:

a first guiding surface on which said buckle slidingly rests;

a second guiding surface opposite said first guiding surface, on which said releasing means slidingly rest; and one pair of containing surfaces opposite each other, between which said guiding surfaces are included;

wherein in said second guiding surface there is said support surface against which said elastic tab projecting from said body of said buckle rests;

wherein said releasing means comprise a button that can be reached by the user when inserted in a top hole present in said handgrip, said button being provided with a sheet projection for releasing said elastic tab from said support surface, said sheet projection being arranged between said second guiding surface and said body of said buckle;

wherein said sheet projection projects from said button, and the releasing means further includes:

a wall that rests on said second guiding surface with one end placed in contact with said elastic tab, and an elastic body in contact with said body of said buckle; and wherein said elastic body is housed in a through opening made in said sheet projection and having a convex part facing towards said body of said buckle.

2. Coupling and releasing unit according to claim 1, wherein said housing is a through hole with closed profile in cross section and arranged obliquely, the through hole passes through said handgrip starting from a top of the handgrip, where it the through hole extends from the top hole and ending in a lateral area, where the through hole defines a side hole.

3. Coupling and releasing unit according to claim 1, wherein said guiding surfaces are mutually inclined and diverging towards the top of said handgrip.

4. Coupling and releasing unit according to claim 1, wherein said support surface projects from said second guiding surface, a free end of said elastic tab that projects from said body of said buckle resting on said support surface.

5. Coupling and releasing unit according to claim 4, wherein the elastic tab has one end belonging to said body of said buckle, while the opposite end is free and spaced from said body of said buckle.

6. Coupling and releasing unit according to claim 5, wherein said elastic tab is inclined and diverging towards the end of said body of said buckle with which said wrist strap is associated.

7. Coupling and releasing unit according to claim 1, wherein said elastic body has one end fixed to said button, and an opposite end that is free.

8. Coupling and releasing unit according to claim 7, wherein in said free end of said elastic body there is at least one projecting shaped part that cooperates with recesses present in said housing.

* * * * *